US009157231B2

(12) United States Patent
Wingfield et al.

(10) Patent No.: US 9,157,231 B2
(45) Date of Patent: Oct. 13, 2015

(54) SOUND CONTROL MAT

(71) Applicants: BONAR INC., Enka, NC (US); MAXXON CORPORATION, Hamel, MN (US)

(72) Inventors: Allan Wingfield, Fairview, NC (US); Jeffrey Scott Denton, Canton, NC (US); Patrick Henry Giles, Anoka, MN (US)

(73) Assignees: BONAR INC., Enka, NC (US); MAXXON CORPORATION, Hamel, MN (US)

( * ) Notice: Subject to any disclaimer, the term of this patent is extended or adjusted under 35 U.S.C. 154(b) by 0 days.

(21) Appl. No.: 14/044,166

(22) Filed: Oct. 2, 2013

(65) Prior Publication Data

US 2014/0097037 A1 Apr. 10, 2014

Related U.S. Application Data

(60) Provisional application No. 61/710,166, filed on Oct. 5, 2012.

(51) Int. Cl.

| | |
|---|---|
| ***E04B 1/84*** | (2006.01) |
| ***E04F 15/18*** | (2006.01) |
| ***E04F 15/20*** | (2006.01) |

(52) U.S. Cl.

CPC ..... *E04B 1/84* (2013.01); *E04F 15/186* (2013.01); *E04F 15/203* (2013.01)

(58) Field of Classification Search

CPC ..... E04F 15/20; E04F 15/206
USPC ..... 181/290
See application file for complete search history.

(56) References Cited

U.S. PATENT DOCUMENTS

| | | | | |
|---|---|---|---|---|
| 3,687,759 | A | 8/1972 | Werner et al. | |
| 3,691,004 | A | 9/1972 | Werner et al. | |
| 4,212,692 | A | 7/1980 | Rasen et al. | |
| 4,685,259 | A | 8/1987 | Eberhart et al. | |
| 4,879,856 | A | 11/1989 | Jones et al. | |
| 7,096,630 | B1 * | 8/2006 | Keene et al. | 52/309.8 |
| 8,136,320 | B2 | 3/2012 | Keene | |
| 8,146,310 | B2 | 4/2012 | Keene | |
| 2003/0033777 | A1 * | 2/2003 | Thiers et al. | 52/390 |
| 2006/0179752 | A1 * | 8/2006 | Swanson et al. | 52/403.1 |
| 2006/0230699 | A1 | 10/2006 | Keene | |
| 2007/0261365 | A1 | 11/2007 | Keene | |
| 2009/0242325 | A1 * | 10/2009 | Dellinger et al. | 181/290 |
| 2009/0283658 | A1 | 11/2009 | Keene | |
| 2010/0229486 | A1 | 9/2010 | Keene | |
| 2011/0107700 | A1 | 5/2011 | Keene | |

* cited by examiner

*Primary Examiner* — Jeremy Luks
(74) *Attorney, Agent, or Firm* — Oliff PLC

(57) ABSTRACT

A sound control mat includes a waterproof separation layer, an entangled monofilament structure, and a meltblown non-woven. The sounds control mat provides improved sound control such as improved impact insulation.

26 Claims, 1 Drawing Sheet

SOUND CONTROL MAT

This application is a non-provisional application of U.S. Provisional Application No. 61/710,166, filed Oct. 5, 2012, the entire disclosure of which is incorporated herein by reference.

BACKGROUND

Sound and the transmission thereof in buildings, particularly between floors in multistory dwellings and commercial buildings, can be a serious problem. Transmitted sound is typically caused by impact generated by forceful meeting of an object with a floor or airborne sound. The transmission of sound between floors may disturb or be an annoyance to individuals present in the area below or adjacent to the room in which the sound is generated.

In general, impact sound is generated due to pedestrian footfall on the floor, movement of objects over the floor, and any other contact made with the floor. Airborne sound is usually due to speech, sound from audio and video equipment, and sound from other objects such as toys, computers, video games, kitchen appliances, fans, and the like. The transmission of sound between floors is particularly a problem where the upper finished flooring is made of flooring, such as concrete, ceramic tiles, hardwood, or resilient flooring. Installation of thick carpeting may be required to prevent the transmission of sound. However, in multi-family, stacked construction, hard surfaces are desirable, yet noisy for surrounding neighbors. Additionally, in many instances, carpet is not an aesthetically desirable component.

An alternative to the use of carpeting to prevent sound transmission has been the use of a sound rated floor system, such as that disclosed in U.S. Pat. No. 4,685,259, or a floating floor, such as that disclosed in U.S. Pat. No. 4,879,856. The use of sound rated floor system or a floating floor substantially reduces the transmission of sound between floors by isolating the flooring from the floor substructure. Products that create a floating floor have resilience and create an air space, where the thicker the air space is and the more the resilience, the better is its performance. Accordingly, what is needed is an improved sound control system that is inexpensive, simple and quick to install, and is resilient.

SUMMARY

Disclosed is a sound control mat comprising a water resistant separation layer, an entangled monofilament structure or core, and an elastic, non-rigid layer.

In embodiments, the sound control mat may be formed in situ, on a subsurface, e.g. a floor surface, by placing the water resistant separation layer, the entangled monofilament structure or core, and the elastic, non-rigid layer on the subfloor surface.

In embodiments, the sound control mat comprises a water resistant separation layer, an entangled monofilament structure or core, and an elastic, non-rigid layer layered together and joined thermally, chemically or mechanically into a single unit for ease of installation. The elastic, non-rigid layer can be attached as a separate product or the elastic, non-rigid layer can be formed directly onto the entangled monofilament structure. When attached as a separate unit, the elastic, non-rigid layer will form an outer layer of the structure; but when formed directly onto the entangled monofilament structure, the elastic, non-rigid layer may fill void spaces and conform the structure of the entangled monofilament structure.

In embodiments, the elastic, non-rigid layer may be a textile fabric, such as a woven fabric or a nonwoven fabric, e.g. a meltblown nonwoven. The meltblown nonwoven can be characterized as a lightweight cohesive structure manufactured from, for example, PP (polypropylene) but could be any polymer that can be used in a melt blowing operation. The structure is essentially incompressible, with little change in thickness demonstrated upon loading. The weight of the meltblown nonwoven can vary from 1 to 20 ounces per square yard (osy), such as 2 to 15 ounces per square yard or 6 to 9 ounces per square yard. The water resistant separation layer provides separation between the entangled monofilament structure and the flooring underlayment. The water resistant separation layer limits water from being transported into the entangled monofilament structure during the curing phase of the underlayment. The separation layer provides support for the underlayment. When the layers of the sound control mat are joined into a single unit, the separation layer also strengthens the entangled monofilament structure by providing tie points for the entangled monofilament structure, increasing the structural integrity of the system and minimizing potential movement, because the waterproof separation layer is bonded to the entangled monofilament structure. In embodiments, the water resistant separation layer is a waterproof separation layer.

The entangled core in embodiments is a polymer structure, e.g. manufactured from PP (polypropylene) or PA6 (polyamide 6, also known as nylon 6), formed by extrusion of the polymer into monofilaments and forming the monofilaments into a three-dimensional structure, e.g. a u-groove, v-groove, or pyramidal structure. The entangled core in embodiments may be shaped in any desired three-dimensional form, such as for example in a series of hills and valleys either being spaced apart by a specified distance or abutted to each other and either being placed in parallel lines or in a staggered formation, or in a series of hemispheres either being spaced apart by a specified distance or abutted to each other and either being placed in parallel lines or in a staggered formation. The entangled core may comprise positive and/or negative cuspates, cups or waffles either being spaced apart by a specified distance or abutted to each other and either being placed in parallel lines or in a staggered formation. Alternatively, the entangled core may comprise a series of pyramids, either being spaced apart by a specified distance or abutted to each other and either being placed in parallel lines or in a staggered formation. The entangled core may also comprise any combination of hills and valleys, hemispheres, positive and/or negative cuspates, cups or waffles, pyramids, U-grooves and/or V-grooves. The structure can have a thickness, for example, ranging from about 3 to about 25 mm in thickness, and can have a basis weight, for example, ranging from about 3 to about 20 osy.

The sound control mat exhibits an increase of at least about 2 points in the Impact Insulation Class (IIC), as determined by ASTM E 492 Field and Lab Standard Test Method for Laboratory Measurement of Impact Sound Transmission Through Floor-Ceiling Assemblies Using the Tapping Machine, over a control composed of the same water resistant layer and the same entangled monofilament structure but excluding the elastic, non-rigid layer. In embodiments, the sound control mat exhibits an increase of at least about 4 points or at least about 6 points, or at least about 8 points, or at least about 10 points in the Impact Insulation Class (IIC) over a control composed of the same water resistant layer and the same entangled monofilament structure but excluding the elastic, non-rigid layer.

The sound control mat has been found to increase the Impact Insulation Class (IIC) by two to eight points over wood or concrete. In embodiments, the sound control mat exhibits an increase of at least about 4 points or at least about 6 points, or at least about 8 points, or at least about 10 points in the Impact Insulation Class (INC) over wood or concrete.

The sound control mat may also exhibit an increase of at least about 2 points in the Sound Transmission Class (STC) over a control composed of the same water resistant layer and the same entangled monofilament structure but excluding the elastic, non-rigid layer. In embodiments, the sound control mat exhibits an increase of at least about 4 points or at least about 6 points, or at least about 8 points, or at least about 10 points in the Impact Insulation Class (IIC) over a control composed of the same water resistant layer and the same entangled monofilament structure but excluding the elastic, non-rigid layer.

The sound control mat may also exhibit an increase of at least about 2 points in the Sound Transmission Class (STC) over wood or concrete. In embodiments, the sound control mat exhibits an increase of at least about 4 points or at least about 6 points, or at least about 8 points, or at least about 10 points in the Sound Transmission Class (STC) over wood or concrete.

For example, the addition of the meltblown nonwoven has been shown to increase the Impact Insulation Class (IIC) by about 2-4 points over a control as determined by ASTM E 492 Field and Lab Standard Test Method for Laboratory Measurement of Impact Sound Transmission Through Floor-Ceiling Assemblies Using the Tapping Machine. Tested samples include AcoustiMat II as a control and AcoustiMat II with 6 osy and 8.8 osy polypropylene meltblown nonwoven layers attached using hot melt adhesive.

DETAILED DESCRIPTION OF THE EMBODIMENTS

In more detail, disclosed is a sound control mat that is suitable for a wide range of applications. The sound control mat is in particular suitable for use in flooring applications, although it will be apparent that the sound control mat can be used in other applications, including in walls or ceilings in building structures, in panels and the like.

When used in a flooring, the sound control mat is typically located above a subfloor surface (such as a wooden subfloor) and below a flooring underlayment and a final desired flooring product. However, in embodiments, the sound control mat can be located in other locations, such as above a subfloor surface and flooring underlayment and below a final desired flooring product. In such applications, the sound control mat can be located above any common or desired subfloor surface or underlayment, such as concrete, other masonry materials such as bricks and blocks, plaster, wood (such as plywood, OSB (oriented strand board), particle board, and the like), vapor barrier products such as plastic films and the like, metal such as metal sheeting, earthen materials such as dirt and clay, and the like. Such subfloor surfaces or underlayments can be bare, such as untreated and unpainted, or they can be processed such as by painting, staining, mortared, and the like. It is also understood that the underlayment can be considered a single layer, or can be a multi-layered such as several layers of wooden materials, wood sheeting over beams, concrete covered by a vapor barrier, concrete covered by a wood product, and the like. One or more additional layers can exist between the sound control mat and adjacent materials, depending on particular applications and as desired.

In embodiments, the sound control mat is located beneath an underlayment and a desired flooring or external layer. Such flooring or external layer can include, for example, one or more of carpet, carpet padding, concrete, other masonry materials such as stone or bricks or blocks, tile, vinyl flooring, plaster, natural or synthetic wood such as decorative wood flooring, and the like. The flooring or external layer can also be in the form of multiple layers, such as carpet padding and carpet, thinset and tile, mesh materials such as used to provided heated floors and the like, resilient flooring, underlayment and wood flooring, and the like. One or more additional layers can also exist between the sound control mat and the flooring or external layer, depending on particular applications and as desired. In uses other than flooring, the external layer can include other materials, such as natural or synthetic wood paneling, wallpaper, paint, drywall or plasterboard, cement board, acoustic tiles, and the like.

Figure 1:
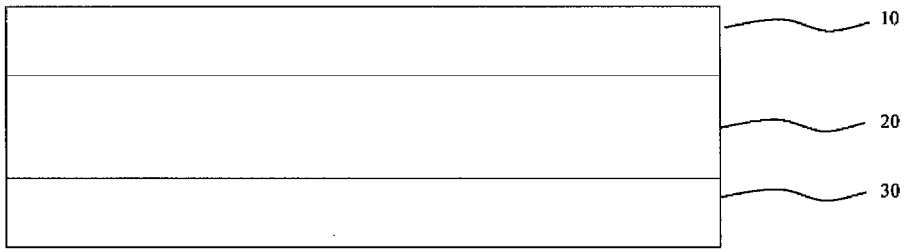
FIG. 1 is a cross-section view of a sound control mat according to an embodiment.

With reference to FIG. 1, the sound control mat generally comprises a water resistant or even a waterproof separation layer 10, an entangled monofilament structure (also referred to herein as a core) 20, and an elastic, non-rigid layer 30. The layers of the separation layer, the entangled monofilament structure, and the elastic, non-rigid layer in embodiments are layered together in that order, although it will be appreciated that for some applications, a different ordering of the layers may be desired. It will also be appreciated that in some embodiments, additional layers or materials can be added to impart different properties to the sound control mat, or to better suit the sound control mat to a particular application.

The layers of the sound control mat can be joined together by any suitable process. In embodiments, the layers of the sound control mat can be joined together into a single unit for ease of installation, such as by one or more processes including thermally, chemically, and mechanically. For example, suitable thermal joining processes may include thermally joining or bonding an elastic, non-rigid layer, for example a textile fabric, e.g. a woven or nonwoven structure (also referred to herein as a "fleece"), or a foam that is not the entangled monofilament structure to the entangled monofilament structure by using a press roll to bring the two into contact while the entangled monofilament structure is still molten from the extrusion process used to create the entangled core; bringing the two into contact and applying sufficient thermal energy through the elastic, non-rigid layer using a hot plate, wedge or other direct contact heating device; bringing the two into contact just after thermal energy is delivered to either or both of the two components using infrared, hot air, or other non-contact heating device; and the like. Suitable chemical bonding processes may include processes similar to the above thermal joining processes, except that chemicals are used instead of thermal energy. For example, an adhesive can be applied with a kiss roll, drip applicator, or by spraying. The adhesive can be a hot-melt adhesive, although other adhesives such moisture curing adhesives, UV curing adhesives, and the like can also be suitably used. Exemplary mechanical bonding processes include, for example, forming the (meltblown) nonwoven or foam directly onto the entangled core; stitching or sewing the components together; and the like. Other suitable methods will also be apparent and can be used.

In embodiments, the fibers or filaments of the textile fabric are hollow fibers or filaments to further increase the Impact Insulation Class (IIC) of the sound control mat. The percentage of the fiber or filament cross sectional area formed by the hollow part is not particularly limited, and may be for example at least about 10% of the cross sectional area of the fiber or filament, or at least about 20%, or at least about 30% or at least about 40% or at least about 50% or at least about 60% or at least about 70% of the cross sectional area of the fiber or filament.

The layers of the sound control mat can be joined together in one or more separate steps. For example, in one embodiment, the water resistant or waterproof separation layer, the entangled monofilament structure, and the elastic, non-rigid layer can all be joined together at the same time in a single processing step. In another embodiment, the water resistant or waterproof separation layer can be joined with the entangled monofilament structure in one step, and the elastic, non-rigid layer can be attached to the other layers as a separate product. Still alternatively, the elastic, non-rigid layer can be formed directly onto the entangled monofilament structure, before or after the separation layer is attached to the other side of the entangled monofilament structure.

Adjusting the joining steps enables the structure of the final product and its properties to be likewise adjusted. For example, when a meltblown nonwoven is attached to the entangled monofilament structure as a separate unit, the meltblown nonwoven will form a separate and distinct layer of the structure. However, when the meltblown nonwoven is attached to the entangled monofilament structure by forming the meltblown nonwoven directly onto the entangled monofilament structure, the meltblown nonwoven may interpenetrate into and fill void spaces of the entangled monofilament structure with fiber, and thus conform the structure of the entangled monofilament structure.

The water resistant or waterproof separation layer provides separation between the entangled filament structure and the flooring underlayment or other underlying or overlying layer. The purpose of the separation layer is to limit water, moisture, or other liquids from being transported into the entangled monofilament structure during the curing phase of the underlayment. Thus, the separation layer allows the sound control mat to be installed over an underlying underlayment that is not yet fully cured (such as over a concrete underlayment or the like that is not yet fully set and dried), or allows a curable underlayment to be applied over the sound control mat. The waterproof separation layer also helps prevent moisture travel from the underlayment into the entangled filament structure over time, such as may occur in an environment that is below ground level or in an environment subject to moisture penetration. The separation layer also provides support for the underlayment after it has cured, and strengthens the entangled filament structure by providing tie points for the entangled filament structure to attach to the underlying layer, thus increasing the structural integrity of the system and minimizing potential movement because the separation layer is bonded to the entangled filament structure.

Any suitable material may be used for forming the water resistant or waterproof separation layer. Suitable materials generally include polymeric films or sheets and rubber films or sheets, although other materials such as metal layers may also be used. If desired for additional strength, the water resistant or waterproof separation layer may further include reinforcement materials, such as reinforcing fibers, embedded in or on the layer. The reinforcing fibers may be included in the waterproof or water resistant separation layer as separate fibers, for example distributed randomly in the separation layer or included as an unidirectional layer of fibers, as a scrim, as a woven fabric and/or as a nonwoven fabric.

Examples of suitable waterproof separation layer include, for example, plastic or polymer sheets and films such as vinyl, polyurethane, polystyrene, polyethylene, polycarbonate, and the like; closed cell foams such as styrofoam and the like; glass; metal such as aluminum and the like; mixtures thereof; and the like. In embodiments, the waterproof separation layer is substantially or completely waterproof, in that it does not under ordinary conditions allow for moisture transport through the layer.

In embodiments, the waterproof separation layer can be provided as a single layer of material, or as a multi-layer structure having two, three, four, or more layers. For example, if desired, the waterproof separation layer can include a waterproof layer formed of any of the materials described above, plus an additional layer or layers on either side of the waterproof layer. Such additional layers may be helpful, for example, to provide increased adhesion between the waterproof separation layer and adjoining layers of the flooring structure and/or the sound control mat.

Figure 2A:
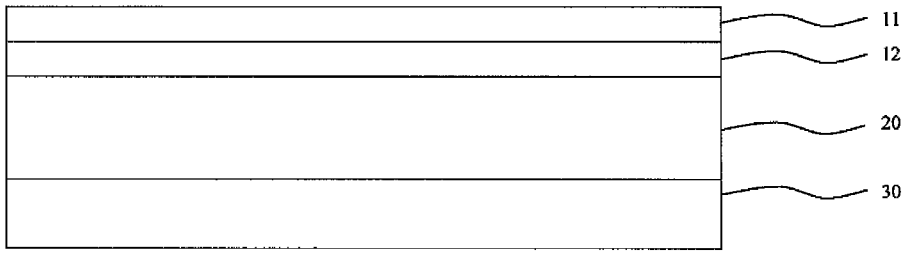
FIGS. 2A and 2B are cross-section views of a sound control mat having a multi-layer structure for the waterproof separation layer.

For example, with reference to FIG. 2A, the waterproof separation layer can be provided as a bilayer structure including a waterproof layer with a fleece layer 11 applied to one side of the waterproof layer 12. Through processing techniques well known in the art, the fleece layer can be made to have various properties and textures, such as having a texture ranging from "fuzzy" or rough to "slick" or smoother. For some applications, a "fuzzy" or rougher texture may be used for the exposed surface of the fleece layer. This fuzzy or rough texture provides the benefit that it helps improve the bond between the sound control mat and the overcoated material. For example, where the sound control mat is to be overcoated with a floor underlayment, such as gypsum concrete, topping, the fuzzy or rough texture provides increased adhesion between the sound control mat and the floor underlayment that would not be provided by the waterproof layer alone without a fleece layer, or by a fleece layer having a smoother or slicker texture. This increased adhesive in turn provides added strength and integrity to the overall structure, and minimizes crack potential in materials covering the sound control mat. Of course, in other applications, a smoother or slicker fleece surface can be suitably used, as desired.

Figure 2B:
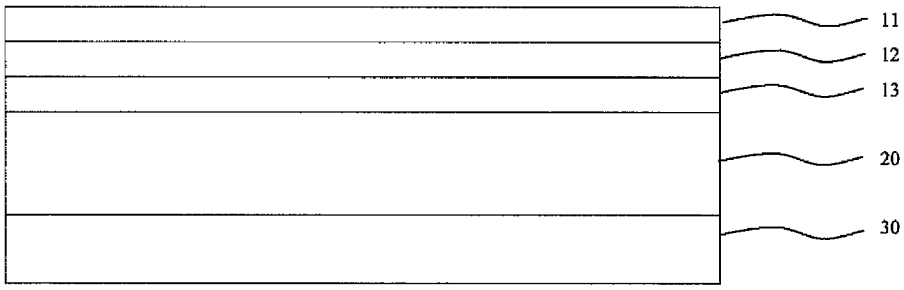

In still other embodiments, with reference to FIG. 2B, the waterproof separation layer can be provided as a trilayer structure, including a waterproof layer 12 with a fleece layer 11, 13 applied to both sides of the waterproof layer. As above, the outer or exposed fleece layer 11 can be suitable processed to have a "fuzzy" or rough, or "slick" or smooth, surface to provide the desired adhesion and other benefits. Similarly, the inner fleece layer 13 can likewise be suitable processed to have a "fuzzy" or rough, or "slick" or smooth, surface. A "fuzzy" or rough surface may be desired, for example, to similarly provide increased adhesion to the underlying entangled monofilament structure. This may be particularly helpful, for example, where the entangled monofilament structure is made of a material such as nylon that is more difficult to adhere to other materials. This may be helpful, for example, because the rough surface provides increased mechanical interaction between the fleece layer and the entangled monofilament structure and/or provides better surfaces to accept and retain an adhesive material or bonding agent. In other embodiments, however, where the entangled monofilament structure is more easily adherable to the fleece layer (such as where the entangled monofilament structure is formed from polypropylene), the fleece layer can have a smoother or slicker texture, or the inner fleece layer can be eliminated entirely to provide the above bilayer structure.

For the fleece layers described herein, any suitable material can be used and are available from a variety of sources. While not limiting, suitable fleece materials that can be used include, for example, FLEXGARD ASPIRE™, ASPIRE SPECIAL™, WHITE WBF-80-F FUZZY FABRIC™, WHITE SEN WBF-80 FABRIC™, and the like. Suitable materials can be obtained from, for example, Twitchell Corp., Engineered Coated Products (ECP), Southeastern Nonwovens (SEN), and the like.

In embodiments, the elastic, non-rigid layer may be a foam. The foam can be characterized as a lightweight polymeric layer containing voids in manufactured from, for example, PP (polypropylene) but could be any polymer that can be used in a foaming operation. The weight of the foam can vary from 1 to 20 ounces per square yard, such as 2 to 15 ounces per square yard or 3 to 9 ounces per square yard.

In embodiments, the thickness of the foam can be, for example, from about 1 or about 2 mm to about 10 or about 20 mm, such as from about 2 mm or about 2.5 mm or about 3 mm to about 5 mm or about 10 mm or about 15 mm. Of course, the thickness, basis weight, and other properties of foam can be adjusted, for example, to provide the desired sound control properties, and the like.

Adjusting the joining steps enables the structure of the final product and its properties to be likewise adjusted. For example, when a foam is attached to the entangled monofilament structure as a separate unit, the foam will form a separate and distinct layer of the structure. However, when the foam is attached to the entangled monofilament structure by forming the foam directly onto the entangled monofilament structure, the foam may interpenetrate into and fill void spaces of the entangled monofilament structure with foam, and thus conform the structure of the entangled monofilament structure.

In embodiments, the elastic, non-rigid layer may be an essentially two-dimensional monofilament structure, e.g. manufactured from a thermoplastic polymer, e.g. PP (polypropylene) or PA6 (polyamide 6, also known as nylon 6), formed by extrusion of the thermoplastic polymer into monofilaments and forming the monofilaments into an essentially two-dimensional structure, e.g. by depositing the monofilaments in an at least partly overlapping manner onto a flat belt or onto a drum having a non-profiled surface. If the filaments are to be bonded together, that bonded can be accomplished by any suitable method, such as by heat fusing.

The filaments used in forming the essentially two-dimensional monofilament structure are not particularly limited, and can be selected based on the desired use of the sound control mat. In embodiments, the filaments have an average diameter of from about 100 microns to about 1100 microns, such as about 200 or about 300 or about 400 to about 800 or about 900 or about 1000 microns. For example, smaller filaments can have an average diameter of from about 100 or about 200 to about 500 or about 600 microns, and larger filaments can have an average diameter of from about 500 or about 600 or about 700 to about 900 or about 1000 or about 1100 microns.

In embodiments, the filaments of the essentially two-dimensional monofilament structure are hollow filaments to further increase the Impact Insulation Class (IIC) of the sound control mat. The percentage of the filament cross sectional area formed by the hollow part is not particularly limited, and may be for example at least about 10% of the cross sectional area of the filament, or at least about 20%, or at least about 30% or at least about 40% or at least about 50% or at least about 60% or at least about 70% of the cross sectional area of the filament.

The weight of the essentially two-dimensional monofilament structure can vary from 1 to 20 ounces per square yard, such as 2 to 15 ounces per square yard or 6 to 9 ounces per square yard.

In embodiments, the essentially two-dimensional monofilament structure is manufactured from a thermoplastic elastomeric polymer, e.g. thermoplastic polyolefin elastomeric polymers (TPO) such as for example thermoplastic polypropylene elastomeric polymer, thermoplastic polyester elastomeric polymers (TPC) such as for example sold under the Arnitel and Pibiflex name, thermoplastic styrenic elastomeric polymers (TPS), or thermoplastic elastomeric polyurethane polymers (TPU) such as for example sold under the Elastollan and Desmopan name.

The entangled filament structure or core is generally a highly porous three dimensional matrix of filamentous material. The filamentous material is generally composed of a plurality of intertwined filaments that twist and turn about at random in the layer, and can either be unbonded, or can be bonded or otherwise connected at random or at regular spaced points. The result is the formation of a three-dimensional, convoluted, and mutually interconnected filamentatious body. If the filaments are to be bonded together, that bonded can be accomplished by any suitable method, such as by heat fusing.

While not limited, the filaments can be made of any desired material, such as thermoplastic materials such as a polyolefin (e.g., polyethylene (e.g., high density polyethylene, low density polyethylene, linear low density polyethylene, and the like), polypropylene, and the like), a polyvinyl halide (e.g., polyvinyl chloride, polyvinylidene chloride, polyvinyltetrafluoride, polyvinyl chlorotrifluoride, and the like), polystyrene, polyamide (e.g., polyamide 6 and the like), a polyester (e.g., polybutylene tereptahlate, polyethylene terephthalate, polytrimethylene terephthalate, and the like), a polyvinylester (e.g., polyvinyl acetate, and the like), and mixtures, copolymers and modifications thereof. Other suitable materials can also be used.

Further details of the formation of an entangled filament structure can be found, for example, in U.S. Pat. Nos. 3,687,759, 3,691,004, 4,212,692, and 7,096,630, the entire disclosures of which are incorporated herein by reference in their entireties.

The entangled filament structure can be provided in any desired form and thickness, depending on the intended use of the final product. In embodiments, the thickness of the entangled filament structure can be, for example, from about 1 or about 2 mm to about 30 or about 50 mm, such as from about 3 mm or about 5 mm or about 10 mm to about 15 mm or about 20 mm or about 25 mm. Similarly, the basis weight of the entangled filament structure can be, for example, from about 1 or about 2 osy (ounces per square yard) to about 30 or about 40 osy, such as from about 3 osy or about 6 osy or about 9 osy to about 12 osy or about 15 osy or about 20 osy. Of course, the thickness, basis weight, and other properties of the entangled filament structure can be adjusted, for example, to provide the desired sound control properties, desired breathability properties within the mat, and the like.

The filaments used in forming the entangled filament structure are not particularly limited, and can be selected based on the desired use of the sound control mat. In embodiments, the filaments have an average diameter of from about 100 microns to about 1100 microns, such as about 200 or about 300 or about 400 to about 800 or about 900 or about 1000 microns. For example, smaller filaments can have an average diameter of from about 100 or about 200 to about 500 or about 600 microns, and larger filaments can have an average diameter of from about 500 or about 600 or about 700 to about 900 or about 1000 or about 1100 microns.

In embodiments, the filaments of the entangled monofilament structure are hollow filaments to further increase the Impact Insulation Class (INC) of the sound control mat. The percentage of the filament cross sectional area formed by the hollow part is not particularly limited, and may be for example at least about 10% of the cross sectional area of the filament, or at least about 20%, or at least about 30% or at least about 40% or at least about 50% or at least about 60% or at least about 70% of the cross sectional area of the filament.

In embodiments, the meltblown nonwoven layer applied over the entangled monofilament structure is generally a lightweight cohesive structure. In embodiments, the meltblown nonwoven layer is essentially incompressible, exhibiting little change in thickness demonstrated upon loading.

The meltblown nonwoven layer may be formed by any suitable method. One exemplary method is by extrusion of thermoplastic polymers from multiple die orifices, which polymer melt streams are immediately attenuated by hot high velocity air or steam along two faces of the die immediately at the location where the polymer exits from the die Orifices. The resulting fibers are entangled into a coherent web in the resulting turbulent airstream prior to collection on a collecting surface. Generally, to provide sufficient integrity and strength, the meltblown webs can be further bonded, such as by through air bonding, heat bonding, e.g. calendering, by ultrasonic bonding, or the like.

While not limited, the meltblown nonwoven layer can be made of any desired material, such as thermoplastic materials such as a polyolefin (e.g., polyethylene, polypropylene, and the like), a polyamide (e.g., polyamide 6 and the like), a polyester (e.g., polybutylene terephthalate, polyethylene terephthalate, polytrimethylene terephthalate, and the like), a thermoplastic elastomer, a polyurethane, and mixtures, copolymers and modifications thereof. Other suitable materials can also be used, including any of those materials commonly used in meltblown nonwoven processes.

The meltblown nonwoven layer can be provided in any desired form and thickness, depending on the intended use of the final product. In embodiments, the thickness of the meltblown nonwoven layer can be, for example, from about 0.10 or about 0.25 mm to about 6 or about 8 mm, such as from about 0.50 mm or about 0.75 mm to about 3 mm or about 4 mm. Similarly, the basis weight of the meltblown nonwoven layer can be, for example, from about 1 or about 2 osy to about 15 or about 20 osy, such as from about 4 or about 6 to about 9 or about 12 osy. Of course, the thickness, basis weight, and other properties of the meltblown nonwoven layer can be adjusted, for example, to provide desired properties and functions.

In embodiments, the fibers of the meltblown nonwoven are hollow fibers to further increase the Impact Insulation Class (IIC) of the sound control mat. The percentage of the fiber cross sectional area formed by the hollow part is not particularly limited, and may be for example at least about 10% of the cross sectional area of the fiber, or at least about 20%, or at least about 30% or at least about 40% or at least about 50% or at least about 60% or at least about 70% of the cross sectional area of the fiber.

In use, it is desired in embodiments that the sound control mat exhibits compression resistance. Compression resistance allows the sound control mat to retain its structural integrity so that the meltblown nonwoven layer and the entangled filament structure continue to provide their sound control benefits, without being compressed into a substantially solid layer. Thus, in embodiments, the sound control mat exhibits compression resistance such that at least about 70% thickness is retained upon a loading to 500 psf (pounds per square foot) loading, as compared to the thickness of the sound control mat without any applied loading. For example, the sound control mat can desirably exhibit compression resistance such that about 70% or about 75% or about 80% or about 85% to about 90% or about 95% or about 100% thickness is retained upon a loading of 500 psf, as compared to the thickness of the sound control mat without any applied loading.

Specific benefits have been found to be provided by inclusion of all of the above layers, including the water resistant or even waterproof separation layer, the entangled monofilament structure, and the elastic, non-rigid layer, e.g. a meltblown nonwoven or a foam. For example, the sound control mat has been found to increase the Impact Insulation Class (IIC) by two to eight points over wood or concrete. For example, the addition of the meltblown nonwoven layer has been found to increase the Impact Insulation Class (IIC) by two to four points over a control material not including the meltblown nonwoven layer. The Impact Insulation Class is determined by using the standard ASTM E 492 Standard Test Method for Laboratory Measurement of Impact Sound Transmission Through Floor-Ceiling Assemblies Using the Tapping Machine. This result was demonstrated using samples of AcoustiMat II as a control and samples of AcoustiMat II modified by applying a polypropylene meltblown nonwoven layer over the sample at weight bases of 6 osy and 8.8 osy using hot melt adhesive.

The sound control mat may exhibit an increase of at least about 2 points in the Impact Insulation Class (IIC), as determined by ASTM E 492 Standard Test Method for Laboratory Measurement of Impact Sound Transmission Through Floor-Ceiling Assemblies Using the Tapping Machine, over a control composed of the same water resistant layer and the same entangled monofilament structure but excluding the elastic, non-rigid layer. In embodiments, the sound control mat exhibits an increase of at least about 4 points or at least about 6 points, or at least about 8 points, or at least about 10 points in the Impact Insulation Class (IIC) over a control composed of the same water resistant layer and the same entangled monofilament structure but excluding the elastic, non-rigid layer.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

A sound control mat structure is prepared to include, in order, a waterproof separation layer, an entangled monofilament structure, and a meltblown nonwoven. The sound control mat is prepared by applying a polypropylene meltblown nonwoven layer over a sample of the AcoustiMat II product (available from Maxxon) at a weight basis of 6 osy using hot melt adhesive.

COMPARATIVE EXAMPLES

Comparative products used include a ¾-inch gyperete (available from Maxxon), AcoustiMat I (available from Maxxon), and AcoustiMat II (available from Maxxon).

Testing

Various floor assemblies are prepared as follows. Floor supports used are UL-546 floor trusses, and UL-589 I-joists. The flooring materials tested include the bare floor support, and the bare floor support overlaid with tile, vinyl plank, floating wood, vinyl/congoleum evolution, vinyl/congoleum plus, and carpet. Each of these floor support-flooring combinations is prepared without an intervening sound control mat product, and with the different sound control mat products of Example 1 and the Comparative Examples.

The resultant floor products are tested for their sound control properties. Specifically, the Impact Insulation Class (IIC) is determined for each flooring sample by using the standard ASTM E 492 Standard Test Method for Laboratory Measurement of Impact Sound Transmission Through Floor-Ceiling Assemblies Using the Tapping Machine. In this testing, a number rating is used to compare and evaluate the performance of floor-ceiling constructions in isolating impact noises. According to the test, decibels are measured at 16 different frequencies coming through the floor, than plotted using the ASTM standard curve to determine the IIC. The results are presented in the following tables.

TABLE 1

IIC Values for UL-546 Floor Truss
(Bare Assembly is IIC = 45)

| Flooring Material | Gypcrete | AcoustiMat I | AcoustiMat II | Example 1 |
|---|---|---|---|---|
| Tile | 36 | 48 | 51 | 55 |
| Vinyl plank | | 50 | 52 | 55 |
| Floating wood | | 53 | 55 | 57 |
| Vinyl/congoleum evolution | 51 | 54 | 55 | 56 |
| Vinyl/congoleum plus | 50 | 53 | 54 | 56 |
| Carpet | 55 | | 57 | 61 |

TABLE 2

IIC Values for UL-589 I-Joist
(Bare Assembly is IIC = 45)

| Flooring Material | Gypcrete | AcoustiMat I | AcoustiMat II | Example 1 |
|---|---|---|---|---|
| Tile | 36 | 48 | 49 | 54 |
| Vinyl plank | 49 | 50 | 51 | 55 |
| Floating wood | 42 | 53 | 53 | 58 |
| Vinyl/congoleum evolution | | | 53 | 58 |
| Vinyl/congoleum plus | | | 52 | 57 |
| Carpet | 55 | | 54 | 61 |

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A sound control mat, comprising:
a water resistant or waterproof separation layer,
an entangled monofilament structure, and
an elastic, non-rigid layer,
wherein the elastic, non-rigid layer is joined to the entangled monofilament structure by forming the elastic, non-rigid layer directly on the entangled monofilament structure such that the elastic, non-rigid layer at least partially interpenetrates into the entangled monofilament structure to fill void spaces and conform to the structure of the entangled monofilament structure.

2. The sound control mat of claim 1 comprising, in order, the water resistant or waterproof separation layer, the entangled monofilament structure, and the elastic, non-rigid layer.

3. The sound control mat of claim 1, wherein the water resistant or waterproof separation layer, the entangled monofilament structure, and the elastic, non-rigid layer are joined together thermally, chemically, or mechanically to provide a unitary structure.

4. The sound control mat of claim 1, wherein the elastic, non-rigid layer is joined to the entangled monofilament structure by an adhesive.

5. The sound control mat of claim 1, wherein the waterproof separation layer prevents moisture transport through the waterproof separation layer into the entangled monofilament structure.

6. The sound control mat of claim 1, wherein the waterproof separation layer comprises at least one material selected from the group consisting of polymeric films or sheets, rubber films or sheets, closed cell foams, glass, metal, and mixtures thereof.

7. The sound control mat of claim 1, wherein the waterproof separation layer comprises reinforcement materials embedded in or on the separation layer.

8. The sound control mat of claim 1, wherein the waterproof separation layer is a bilayer structure comprising a waterproof layer and a fleece layer.

9. The sound control mat of claim 8, wherein an exposed surface of the fleece layer has a rough texture.

10. The sound control mat of claim 1, wherein the waterproof separation layer is a trilayer structure comprising, in order, an inner layer facing the entangled monofilament structure, a waterproof layer, and an outer fleece layer.

11. The sound control mat of claim 10, wherein an exposed surface of the outer fleece layer has a rough texture.

12. The sound control mat of claim 1, wherein the entangled monofilament structure comprises at least one member selected from the group consisting of polyolefin, polyvinyl halide, polystyrene, polyamide, polyester, polyvinylester, and mixtures and copolymers thereof.

13. The sound control mat of claim 1, wherein the entangled monofilament structure has a thickness of from about 1 to about 50 mm.

14. The sound control mat of claim 1, wherein the entangled monofilament structure has a basis weight of from about 1 to about 40 osy.

15. The sound control mat of claim 1, wherein the entangled monofilament structure comprises monofilaments having an average diameter of from about 100 microns to about 1100 microns.

16. The sound control mat of claim 1, wherein the elastic, non-rigid layer is a textile fabric.

17. The sound control mat of claim 16, wherein the elastic, non-rigid layer is a meltblown nonwoven layer.

18. The sound control mat of claim 17, wherein the meltblown nonwoven layer is essentially incompressible.

19. The sound control mat of claim 17, wherein the melt-blown nonwoven layer comprises at least one material selected from the group consisting of polyolefin, polyamide, polyester, thermoplastic elastomer, polyurethane, and mixtures and copolymers thereof.

20. The sound control mat of claim 17, wherein the melt-blown nonwoven layer has a thickness of from about 0.1 to about 8 mm.

21. The sound control mat of claim 17, wherein the melt-blown nonwoven layer has a basis weight of from about 1 to about 20 osy.

22. The sound control mat of claim 1, wherein the sound control mat exhibits compression resistance such that at least about 70% thickness is retained upon a loading of 500 psf, as compared to a thickness of the sound control mat without any applied loading.

23. The sound control mat of claim 16, wherein the elastic, non-rigid layer is an essentially two-dimensional monofilament structure.

24. The sound control mat of claim 19, wherein the essentially two-dimensional monofilament structure comprises monofilaments having an average diameter of from about 100 microns to about 1100 microns.

25. The sound control mat of claim 23, wherein monofilaments of the essentially two-dimensional monofilament structure are manufactured from a thermoplastic elastomeric polymer.

26. The sound control mat of claim 1, wherein the elastic, non-rigid layer is a foam layer.

* * * * *